US006688895B1

(12) United States Patent
Fan

(10) Patent No.: US 6,688,895 B1
(45) Date of Patent: Feb. 10, 2004

(54) ELECTRIC CONNECTOR HAVING IMPROVED CONTACT

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/426,825

(22) Filed: Apr. 29, 2003

(30) Foreign Application Priority Data

Apr. 9, 2003 (TW) ..... 92205560

(51) Int. Cl.[7] ..... H01R 12/00
(52) U.S. Cl. ..... 439/82; 439/751; 439/943
(58) Field of Search ..... 439/82, 751, 943, 439/876

(56) References Cited

U.S. PATENT DOCUMENTS 5,160,270 A * 11/1992 Reymond ..... 439/70
5,213,514 A * 5/1993 Arai ..... 439/79
5,240,422 A * 8/1993 Kobayashi et al. ..... 439/78
5,374,204 A * 12/1994 Foley et al. ..... 439/751
6,450,839 B1 * 9/2002 Min et al. ..... 439/751

FOREIGN PATENT DOCUMENTS

JP 54-131868 * 10/1979 ..... 439/82
JP 1-115070 * 5/1989 ..... 439/82

* cited by examiner

*Primary Examiner*—Tho D. Ta
(74) *Attorney, Agent, or Firm*—Wei Te Chung

(57) ABSTRACT

An electrical connector comprises an insulative housing (10), and a member of contacts (30) received in the housing. The insulative housing has a mating portion (13) and a mounting portion (110). Each contact includes an intermediate retention section (32), an upper mating section (31) adapted for mating with an engaging contact of a complementary connector, and a lower mounting section (36) adapted for inserting into a printed circuit board. The mounting section includes a first flexible portion (36), a bent portion, and a second flexible portion (37) extending upwardly from the bent portion.

11 Claims, 4 Drawing Sheets

ELECTRIC CONNECTOR HAVING IMPROVED CONTACT

BACKGROUND OF THE INVENTION

1. Field of the Invention

The present invention relates to a connector mounted on a printed circuit board (PCB), and particularly to such connector having improved contacts for reliably securing the connector to the PCB.

2. Description of Related Art

With the development of electronics technology, the technique of manufacturing and assembling is more and more mature so that cost can be reduced to promote the competitiveness in the market. It is known Through Hole Technology (THT) and Surface Mount Technology (SMT) are usually used for soldering contacts of connectors on the PCB, but some disadvantages still exist: during the soldering process, some residual stress is present on the PCB, soldering material remains on the PCB causing short circuit between contacts, and some compositions of the soldering material will pollute the environment. Thus, a non-soldering technology is developed. U.S. Pat. Nos. 6,206,735 B1; 6,042,429 B1; and 6,052,895 B1, JP Pat. Nos. 2000-215951 and 2000-340285, and ROC Pat. Nos. 461600 disclose such a connector assembled to the PCB without soldering.

In the patents mentioned above, the connectors are assembled to the PCB by press-fit and the contacts connect the metal layer of the corresponding holes of the PCB to achieve an electrical connection. Although the manner of connection can avoid the disadvantages inherent in the soldering process, and can to some extent reduce cost of assembly, the configuration of the contact is complicated and therefore the cost of manufacturing increases, and a greater force is required when the contacts are press-fitted into the containing holes of the PCB. It is desired to provide a new connector assembly having an improved contact to overcome the disadvantages of the prior art.

SUMMARY OF THE INVENTION

Accordingly, one object of the present invention is to provide a connector having a improved contact for electrically connecting a PCB without solding process and reducing cost of assembly.

Another object of the present invention is to provide a connector having simple configuration of contacts, which can reduce mating force when the contacts are press-fitted into the PCB.

In order to achieve the object set forth, an electrical connector, comprising an insulative housing, a plurality of contacts received in the housing. The inslative housing has a mating portion and a mounting portion. The plurality of contact are received in the housing, each contact includes an intermediate retention section, an upper mating section adapted for mating with an engaging contact of a complementary connector, and a lower mounting section adapted for inserting into a printed circuit board. The mounting section includes a first flexible portion, a bent portion, and a second flexible portion extending upwardly from the bent portion.

Other objects, advantages and novel features of the invention will become more apparent from the following detailed description when taken in conjunction with the accompanying drawings.

DETAILED DESCRIPTION OF THE INVENTION

Figure 1:
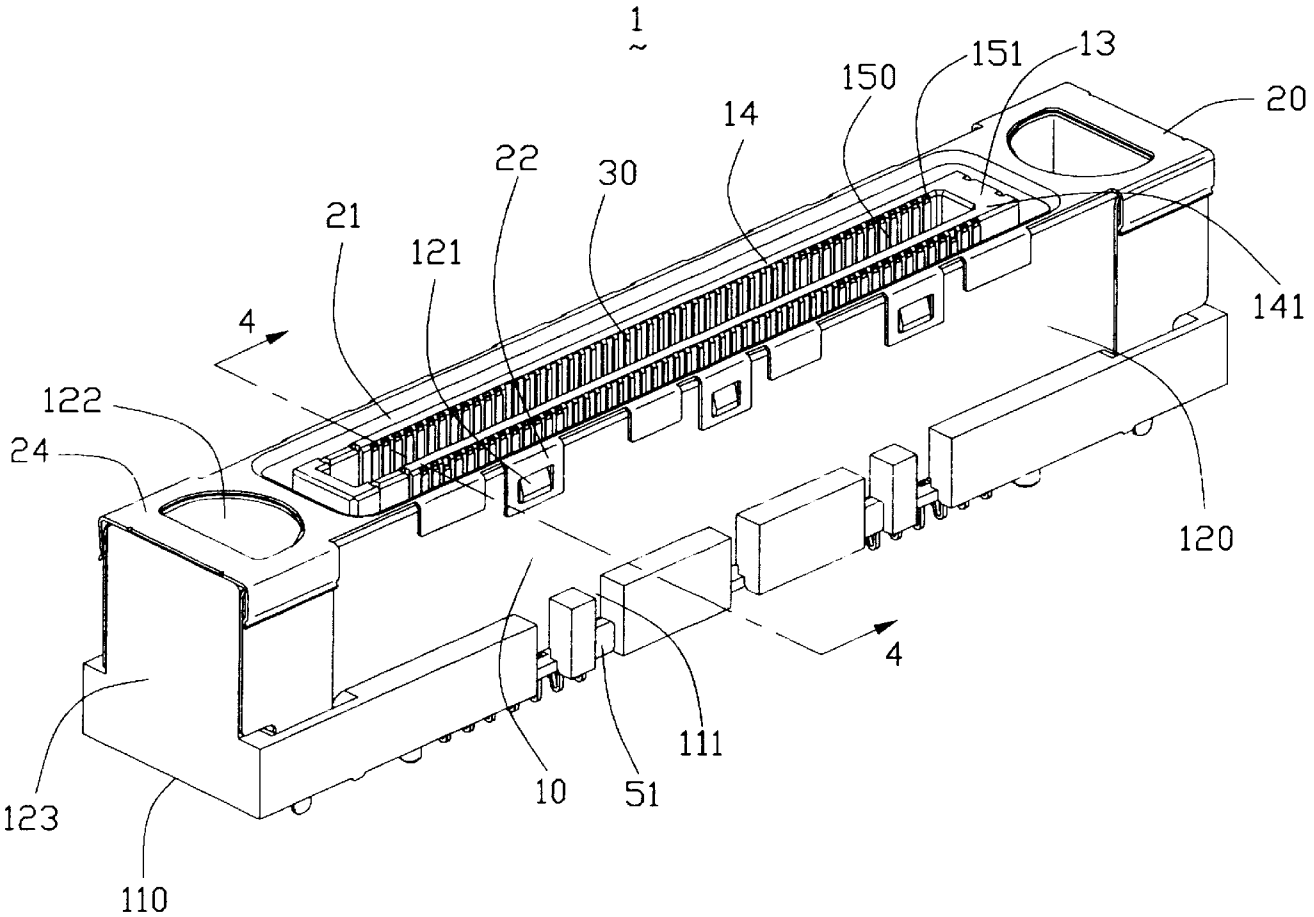
FIG. 1 is a perspective assembled view of a connector in accordance with the present invention.

Referring to FIGS. 1–4, a connector 1 mounted on a printed circuit board (PCB) 4 of the present invention comprises an elongate insulative housing 10, a plurality of contacts 30, a spacer 50, and a shield 20.

The insulative housing 10 comprises a mating portion 13, a mounting portion 110 opposite the mating portion 13 and mounted on the PCB 4, a pair of body portion 120 extending along a up-to-low direction, and a pair of side walls 123 formed on the lateral ends of the body portion 120. The body portion 120 and the side walls connect the mating portion 13 and the mounting portion 110. The mating portion 13 defines a receiving space 150. A pair of tongue plates 14 are installed in the receiving space 150. A plurality of passageways 151 extend through the surface of the tongue plates 14. A connecting portion 141 connects the ends of the pair of tongue plates 14. The mating portion 13 defines a pair of D-shaped guiding holes at the lateral sides thereof. The body portion 120 forms a plurality of projection 121 at the lateral sides adjacent to the mating portion 13. The mounting portion 110 defines a rectangular depression 112. The body portion 120 defines a plurality of locking portion 111 adjacent to the mounting portion 110. A pair of retention posts 113 extend downwardly and exposed to the mounting portion 110.

The plurality of contacts 30 are received in the passageways 151 of the insulative housing 10. Each contact comprises a mating section 31, a retention section 32 extending downwardly from the mating section 31, a connecting section 33 bent outwardly from the retention section 32, a mounting section 35 extending downwardly from the connecting section 33, a first flexible portion 36 extending downwardly from the mounting section 35, a bent/bight portion 38 bent inwardly from the mounting section 35 and exposed to the bottom surface of PCB, and a second flexible portion 37 extending upwardly from the bent portion 38. Each retention section 32 forms a protrusion 34 at the lateral side for being securely received in the passageway 151 of the insulative housing 10. In order to enlarge the distance between the contacts 30, the bending direction and length are not the same between the connecting portions 33 of the contacts 30. A plurality of containing holes 41 contains the tail end of the contacts 30. Each containing hole 41 comprises two side walls plating metal films 42. In assembly, the connector 1 is assembled to the PCB 4, and the first flexible portions 36 is received perpendicularly in the containing holes 41 and abut against the metal films 42. The tail ends of the second flexible portions 37 abut against the side walls and electrically connect the metal films 42 of the containing holes 41. The width of the bent portion 38 is smaller than the width of the containing hole 41. In this manner, the largest distance is between the end of the second flexible portion 37 and the first flexible portion 36. When the connector is assembled to the PCB 4, the end of the second flexible portion 37 abuts against the metal film 42 and provides non-returning function. In other cases, as long as second flexible portion 37 provide enough resilience, the second flexible portion 37 can be bent to form a curve projection to connect the containing hole 41.

Figure 2:
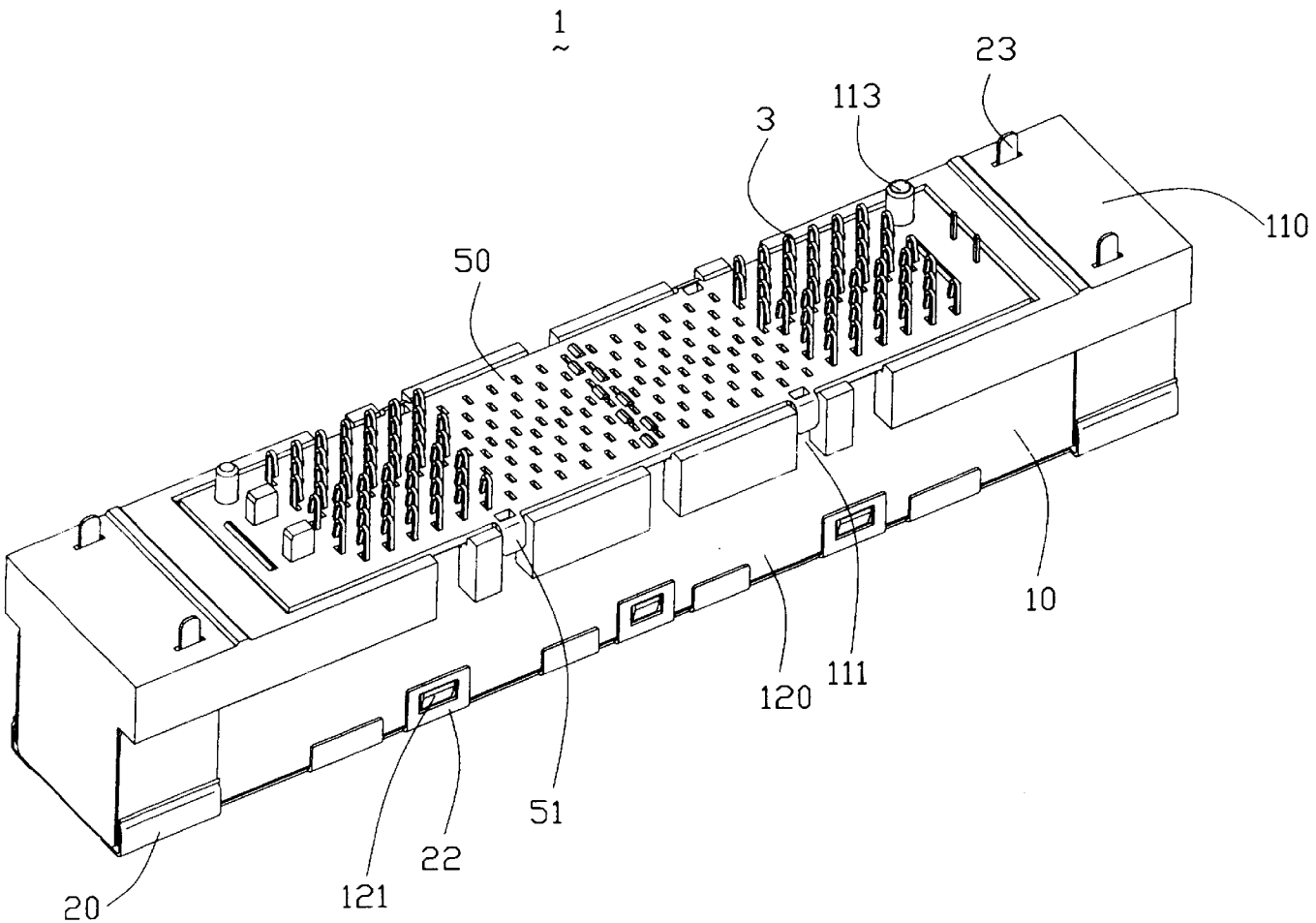
FIG. 2 is a view similar to FIG. 1, from a bottom aspect.

Referring to FIG. 1 and FIG. 2, the shell 4 is stamped from a metal sheet and has a main shield 24 covering the mating portion 13 of the insulative hosing 10. A frame shield 21 extends inwardly into to the receiving space 150 from the main shield 24 and covers the two side walls of the receiving space 150. A securing post 23 extends through the mounting portion 110 from the main shield 24 and connects electrically the PCB 4. The first shield defines a pair of D-shaped holes corresponding to the guiding holes of the insulative housing 10. The frame shield 21 forms a plurality of locking plate 22 bent outwardly and defines a plurality of rectangular holes (not labeled) locking the corresponding projections 121 of the insulative hosing 10.

Figure 3:
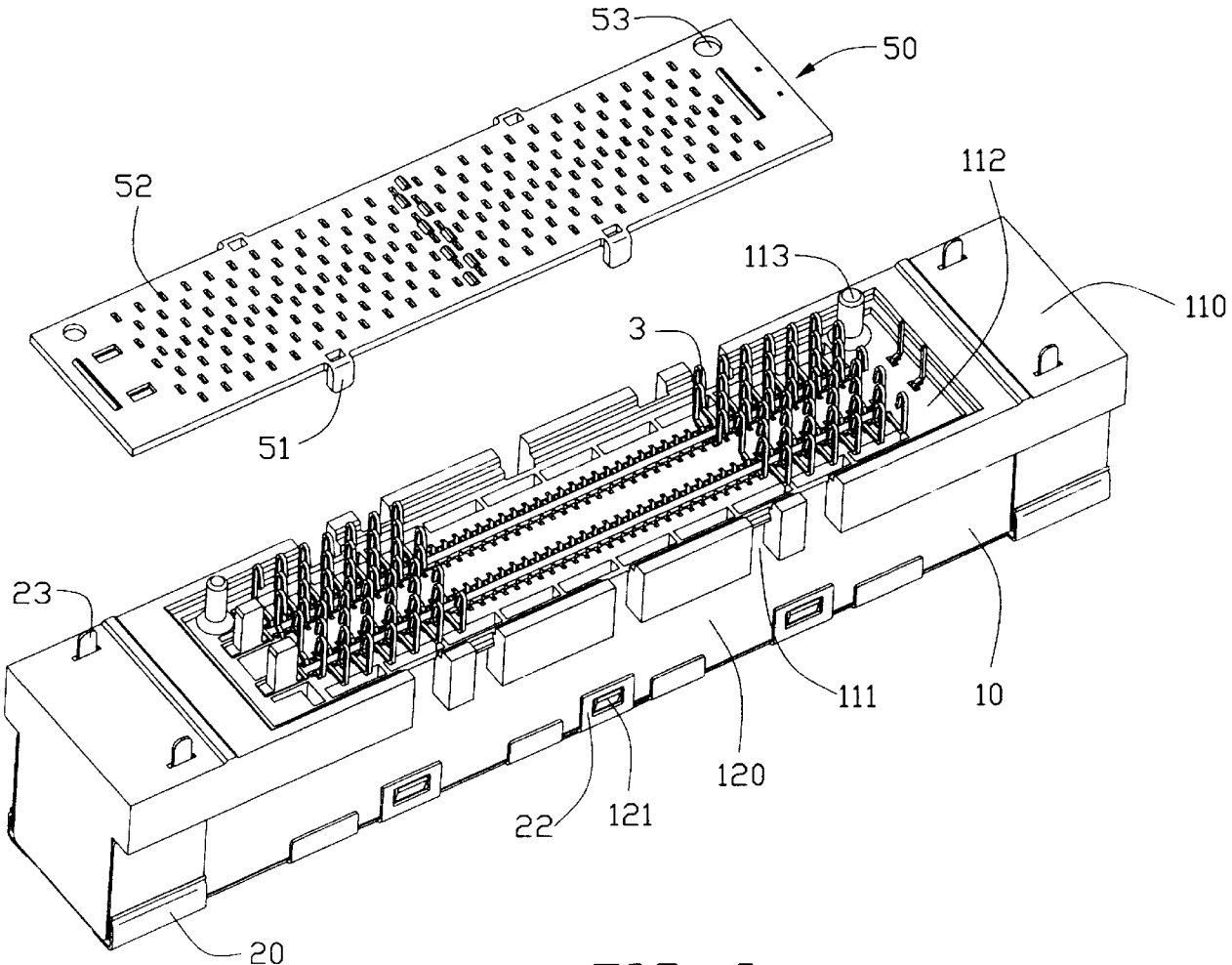
FIG. 3 is a view similar to FIG. 2, but a spacer is separate from the connector.
Figure 4:
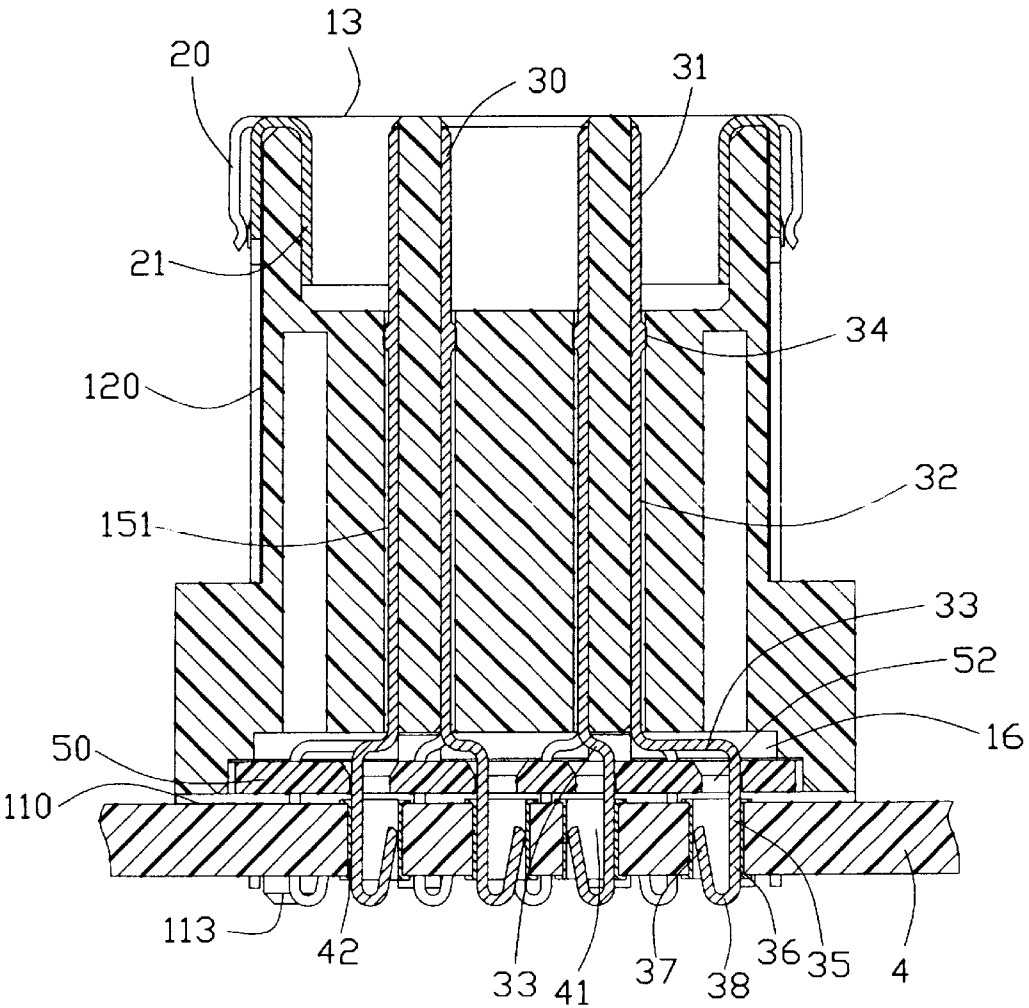
FIG. 4 is a cross-sectional view taken along line IV—IV of FIG. 1.

Referring to FIG. 3, the spacer 50 is a rectangular insulative plate and assembled to the rectangular depression 112 of the insulative housing 10. The spacer 50 defines a plurality of the positioning holes 52 for positioning the mounting sections 35 of the contacts 30. A plurality of locking arms 51 padlock the locking portion 111, A pair of corresponding holes 113 contain the guiding post 113. Referring to the FIG. 4, the spacer 50 and the mounting portion 110 define a plurality of the receiving space 16 for receiving the connecting sections 33 of the contacts 30.

In accordance with the connector 1 of the present invention, the structure of the contact 30 is simplified, the mounting portion 35 is fitted into the corresponding containing holes 41 of the PCB, and the first flexible portion 36 and the second flexible portion 37 abut against the metal films 42 of the containing 41 to achieve a electrically connection. This construction can meet the requirement of reduced assembly cost, and the second flexible portion 37 needs a smaller force to press-fit to the PCB 4 via the elastic fiction of the bent portion 38.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a mating portion and a mounting portion; and a plurality of contacts received in the housing, each contact including an intermediate retention section, an upper mating section adapted for mating with an engaging contact of a complementary connector, and a lower mounting section adapted for inserting into a printed circuit board (PCB), the mounting section including a first flexible portion, a bent portion, and a second flexible portion extending upwardly from the bent portion; and wherein the first flexible portion of the contact is perpendicular to the PCB;

wherein the contact further comprises a connecting section between the retention section and the mounting section;

wherein at least one of the connecting sections of the contacts has a different length than the other connecting sections.

2. The electrical connector as described in claim 1, wherein the retention section forms a protrusion adjacent to the mating portion.

3. The electrical connector as described in claim 1, wherein further comprising a shell shielding the housing.

4. The electrical connector as described in claim 1, wherein the mating portion of the housing defines a receiving space and a tongue plate in the receiving space, and the mating section of the contact is received in the tongue plate.

5. The electrical connector as described in claim 1, further comprising a spacer assembled to the mounting portion of the housing and defining a plurality of positioning holes for positioning the mounting sections of the contacts.

6. The electrical connector as described in claim 5, wherein the spacer and the mounting portion define a receiving space therebetween for accommodating the connecting sections.

7. An electrical connector assembly, comprising:

a printed circuit board (PCB) defining a plurality of containing holes having two side walls, each side wall is planted metal films on the surface thereof; and an insulative housing having a mounting portion mounted on the PCB; and a plurality of contacts received in the housing, each contact including a retention section, a mating section extending upwardly from the retention section, and a mounting section extending downwardly from the retention section and mounted on the PCB, the mounting section including an upwardly extending flexible portion inserted into and abutting against the containing hole; and wherein the contact further comprises a downwardly extending flexible portion inserted perpendicularly into the containing hole of the PCB;

wherein a bent Portion connects the upwardly extending flexible portion and downwardly extending flexible portion and is exposed to the bottom surface of the PCB;

wherein the contact further comprises a connecting section between the retention section and the mounting section;

wherein at least one of the connecting sections of the contacts has a different length than the other connecting sections.

8. The electrical connector as described in claim 7, wherein the retention section forms a protrusion adjacent to the mating portion.

9. The electrical connector as described in claim 7, further comprising a spacer assembled to the mounting portion of the housing and defining a plurality of positioning holes for positioning the mounting sections of the contacts, the spacer and the mounting portion defining a receiving space therebetween.

10. The electrical connector as described in claim 7, wherein further comprising a shell shielding the housing.

11. The electrical connector as described in claim 7, wherein the housing further comprises a mating portion defining a receiving space and a tongue plate in the receiving space, and the mating section of the contact is received in the tongue plate.

* * * * *